US008317390B2

(12) United States Patent
Albrecht

(10) Patent No.: US 8,317,390 B2
(45) Date of Patent: Nov. 27, 2012

(54) STEPPED DOWN GAS MIXING DEVICE

(75) Inventor: Melvin J. Albrecht, Homeworth, OH (US)

(73) Assignee: Babcock & Wilcox Power Generation Group, Inc., Barberton, OH (US)

( * ) Notice: Subject to any disclaimer, the term of this patent is extended or adjusted under 35 U.S.C. 154(b) by 556 days.

(21) Appl. No.: 12/699,407

(22) Filed: Feb. 3, 2010

(65) Prior Publication Data

US 2011/0188338 A1 Aug. 4, 2011

(51) Int. Cl.
*B01F 5/06* (2006.01)

(52) U.S. Cl. ..... 366/337; 366/338

(58) Field of Classification Search ..... 366/336–341, 366/181.5; 110/147; 48/189.4
See application file for complete search history.

(56) References Cited

U.S. PATENT DOCUMENTS

| | | | | |
|---|---|---|---|---|
| 4,793,247 | A * | 12/1988 | Verweij | 366/338 |
| 5,489,153 | A * | 2/1996 | Berner et al. | 366/337 |
| 5,749,651 | A * | 5/1998 | Huttenhofer et al. | 366/181.5 |
| 6,135,629 | A * | 10/2000 | Dohmann | 366/181.5 |
| 7,448,794 | B2 * | 11/2008 | Hansen | 366/174.1 |
| 7,547,134 | B2 * | 6/2009 | Hansen | 366/175.2 |
| 8,096,701 | B2 * | 1/2012 | Beckmann et al. | 366/181.5 |
| 2002/0126572 | A1 * | 9/2002 | Yazici et al. | 366/338 |
| 2005/0190643 | A1 * | 9/2005 | Hansen | 366/181.5 |
| 2006/0256649 | A1 * | 11/2006 | Truce et al. | 366/337 |
| 2006/0266267 | A1 * | 11/2006 | Albrecht et al. | 110/147 |
| 2011/0188338 | A1 * | 8/2011 | Albrecht | 366/181.5 |

FOREIGN PATENT DOCUMENTS

EP 526392 A1 * 2/1993

* cited by examiner

*Primary Examiner* — Charles E Cooley
(74) *Attorney, Agent, or Firm* — Michael J. Seymour

(57) ABSTRACT

An apparatus and method for mixing gas streams of different temperatures and/or compositions contemplates that at least one of the streams contains particle. The apparatus includes a main duct for the first gas stream and a plurality of duct assemblies extending in the main duct generally transversely to the first gas stream. Each assembly has plural inlets and outlets for receiving and discharging separate parts of the second gas stream, moving initially generally transverse to the first stream. The assemblies each have plural secondary ducts of mutually different lengths from inlet to outlet, the outlets being spaced from each other across the main duct for distributing the parts of the second gas stream into the first gas stream. A gas flow deflector is connected to each duct assembly for temporarily deflecting the first gas stream before it is combined with the parts of the second gas stream.

22 Claims, 5 Drawing Sheets

STEPPED DOWN GAS MIXING DEVICE

FIELD AND BACKGROUND OF THE INVENTION

The present invention relates generally to the field of furnaces and boilers, and in particular to new and useful apparatus and method of efficiently mixing gas streams containing particles, with each other.

The present invention is generally drawn to devices for distributing and mixing particle or injected gas laden air in ducts and more particularly to such devices as used in the ducts of power generating stations which may contain ammonia for NOx reduction apparatuses.

It is known to use air foils for distributing and mixing air streams in secondary air supply ducts and selective catalyst reduction (SCR) system flues. The usual arrangement comprises a plurality of whole foils in the center of the flue and half foils at the walls of the flue. Another example of prior art air foil uses an air foil configuration for distributing and mixing economizer bypass flue gas used in the Kansas City Power & Light, Hawthorn Station in their SCR flue system. This system uses a basic system of air foils but has gas-flow ordering plates added. Contour lines in an airflow diagram of such a device show how the airfoils and plates act in the air stream to enhance mixing of the gases in the duct. See Published US Patent Application 2006/0266267 to Albrecht et al, herein incorporated by reference.

In addition, air foils have been used extensively for flow measurement and control. It is also known to use Diamond shaped flow devices for flow control with low pressure drop. For example, many commercially available dampers contain diamond shaped blades. Such devices achieve good flow control with minimal pressure drop.

Disadvantage of the above described prior art arrangements are added pressure loss, potential degradation mixing of ammonia when added, and the requirement for a larger flue to accommodate the system components. Ammonia injection grids (AIG) with zone control are known and have been installed to distribute a prescribed rate of ammonia for NOx reducing SCR systems. Static mixers are commercially available in several forms and have been proposed to reduce thermal and/or flue gas species gradients by adding turbulent mixing in SCR flue systems. Koch and Chemineer are manufacturers that produce some such commercially available static mixers. Design requirements for secondary flues and SCR systems include the specification of flow distribution and thermal gradients downstream of the mixing devices. The objectives are to achieve flow uniformly and minimize thermal gradients. For example, in an SCR system mixing and flow uniformity at the ammonia injection grid should be sufficient such that catalyst performance and life is maintained. To accomplish these goals, devices such as those of the prior art have been utilized. While it is also desirable to minimize the unrecoverable pressure loss to the system, space restrictions limit the installation of an air foil for gas mixing and a separate AIG for ammonia distribution in an SCR system. Thus a uniform distribution system for such applications was needed which would also minimize the pressure loss therein.

Published US Patent Application 2006/0266267 to Albrecht et al., mentioned above, discloses a flow enhancing arrangement for ducts such as rectangular flue ducts wherein a series of tear shaped foils are spaced from each other and mounted in the duct extending from top to bottom thereof and where a series of diamond shaped vanes also extending from the top to the bottom of the duct are spaced and mounted between tear shaped foils to provide a more uniform flow distribution and to lower the pressure thereby. A series of baffles extending from both the tear shaped foils and the diamond shaped vanes may also be used.

U.S. Pat. No. 6,887,435 to Albrecht et al., herein incorporated by reference, discloses an integrated air foil and ammonia injection grid provides a plurality of air foils across a flue conveying flue gas. Each air foil has a leading curved edge and a tapered, pointed, trailing end. At least one injection pipe is positioned inside each air foil, and has at least one nozzle for injecting ammonia into the flue gas flowing across the air foils. Preferably, plural injection tubes are provided and positioned one behind the other in each air foil, and each injection tube in a given air foil has a length different than a length of the other injection tubes in the same air foil. A longest injection tube in a given air foil is located furthest downstream and proximate the tapered trailing edge and a shortest injection tube in the same air foil is located furthest upstream, remaining injection tubes in the same air foil being progressively shorter the further upstream any injection tube is located. Apertures may be provided on opposed lateral sides of the air foils for introducing a gas flow into the flue gas passing across the air foils. Ammonia flow to each injection pipe may be individually controlled.

U.S. Pat. No. 4,980,099 to Myers et al. discloses an apparatus for spraying an atomized mixture into a gas stream comprises a stream line airfoil member having a large radius leading edge and a small radius trailing edge. A nozzle assembly pierces the trailing edge of the airfoil member and is concentrically surrounded by a nacelle which directs shielding gas from the interior of the airfoil member around the nozzle assembly. Flowable medium to be atomized and atomizing gas for atomizing the medium are supplied in concentric conduits to the nozzle. A plurality of nozzles each surrounded by a nacelle are spaced along the trailing edge of the airfoil member.

Air foils for distributing and mixing gas streams have been used in secondary air supply ducts and selective catalyst reduction (SCR) system flues. The arrangement consists of a plurality of whole foils in the center of the flue and/or half foils at the wall of the flue as used for the Eastman Kodak facility identified above.

Another example of an air foil configuration for distributing and mixing economizer bypass flue gas was used in the Kansas City Power & Light, Hawthorn Station SCR flue system. In addition, air foils have been used extensively for flow measurement and control. Ammonia injection grids (AIG) with zone control have been installed to distribute a prescribed rate of ammonia for NOx reducing SCR systems. Static mixers are commercially available in several forms and have been proposed to reduce thermal and/or flue gas species gradients by adding turbulent mixing in SCR flue systems. Koch and Chemineer produce some examples of commercially available static mixers.

Diamond shaped flow devices have been used for flow control with low pressure drop. For example, many commercially available dampers contain diamond shaped blades. Such devices achieve good flow control with minimal pressure drop.

Design requirements for secondary flues and SCR systems include the specification of flow distribution and thermal gradients downstream of the mixing devices. The objectives are to achieve flow uniformity and minimize thermal gradients. In addition, space restrictions limit the installation of an air foil for gas mixing and a separate AIG for ammonia distribution in an SCR system.

Alternatives are to use air foils to distribute the flue gas within the flue and to include plates or baffles to promote flow mixing in the flue/duct. The disadvantage of such an arrangement is added pressure loss, potential degradation mixing, and a larger flue to accommodate the system components.

A need remains for an effective and simple apparatus for mixing of gas streams, in particular streams of different temperatures and/or compositions, and that contain particles such as ash.

SUMMARY OF THE INVENTION

It is an object of the present invention to achieve flow uniformity and minimize thermal gradients. For example, in an SCR system mixing and flow uniformity at the ammonia injection grid should be sufficient such that catalyst performance and life is maintained. It is a further object of the present invention to minimize unrecoverable pressure loss to the system. The invention described accomplishes the aforementioned goals by using an integrated device that satisfies the SCR system design requirements.

Another object of the invention is to provide an apparatus and method for mixing gas streams of different temperatures and/or compositions that contemplates that at least one of the streams contains particles. The apparatus includes a main duct for the first gas stream and a plurality of duct assemblies extending in the main duct generally transversely to the first gas stream. Each assembly has plural inlets and outlets for receiving and discharging separate parts of the second gas stream, moving initially generally transversely to the first stream. The assemblies each have plural secondary ducts of mutually different lengths from inlet to outlet, the outlets being spaced from each other across the main duct for distributing the parts of the second gas stream into the first gas stream. A gas flow deflector is connected to each duct assembly for temporarily deflecting the first gas stream before it is combined with the parts of the second gas stream.

A further object of the invention is to provide an apparatus for mixing two gas streams of different temperatures or different compositions or both, with each other, wherein at least one of the streams contains particles, the apparatus comprising: a main duct for carrying a first gas stream in a first direction; a plurality of duct assemblies extending in the main duct, generally transversely to the first direction, each duct assembly have a plurality of inlets each for receiving part of a second gas stream moving in a second direction that is generally transverse to the first direction, each duct assembly also have a plurality of outlets each for discharging the part of the second gas stream from its inlet, in a direction that is generally parallel to the first direction, each duct assembly comprising a plurality of secondary ducts that have mutually different lengths from the inlet to the outlet for each respective secondary duct, the outlets of the secondary ducts being spaced from each other across the main duct for distributing the parts of the second gas stream into the first gas stream; and a gas flow deflector connected to each duct assembly for temporarily deflecting the first gas stream from the first direction before it is combined with each part of the second gas stream downstream of each outlet for mixing the first and second gas streams with each other as the first gas stream passes the plurality of duct assemblies in the main duct.

The invention's mixing characteristics produce a device and method that promotes a uniform flow distribution with low pressure drop. The device and method also eliminates any limitations on the amount of recirculation flow through the invention by allowing for variations in the cross sectional flow area of the recirculation portion of the device. In addition, through the use of special discharge outlets, this invention can be used in vertical or horizontal oriented flues or ducts.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
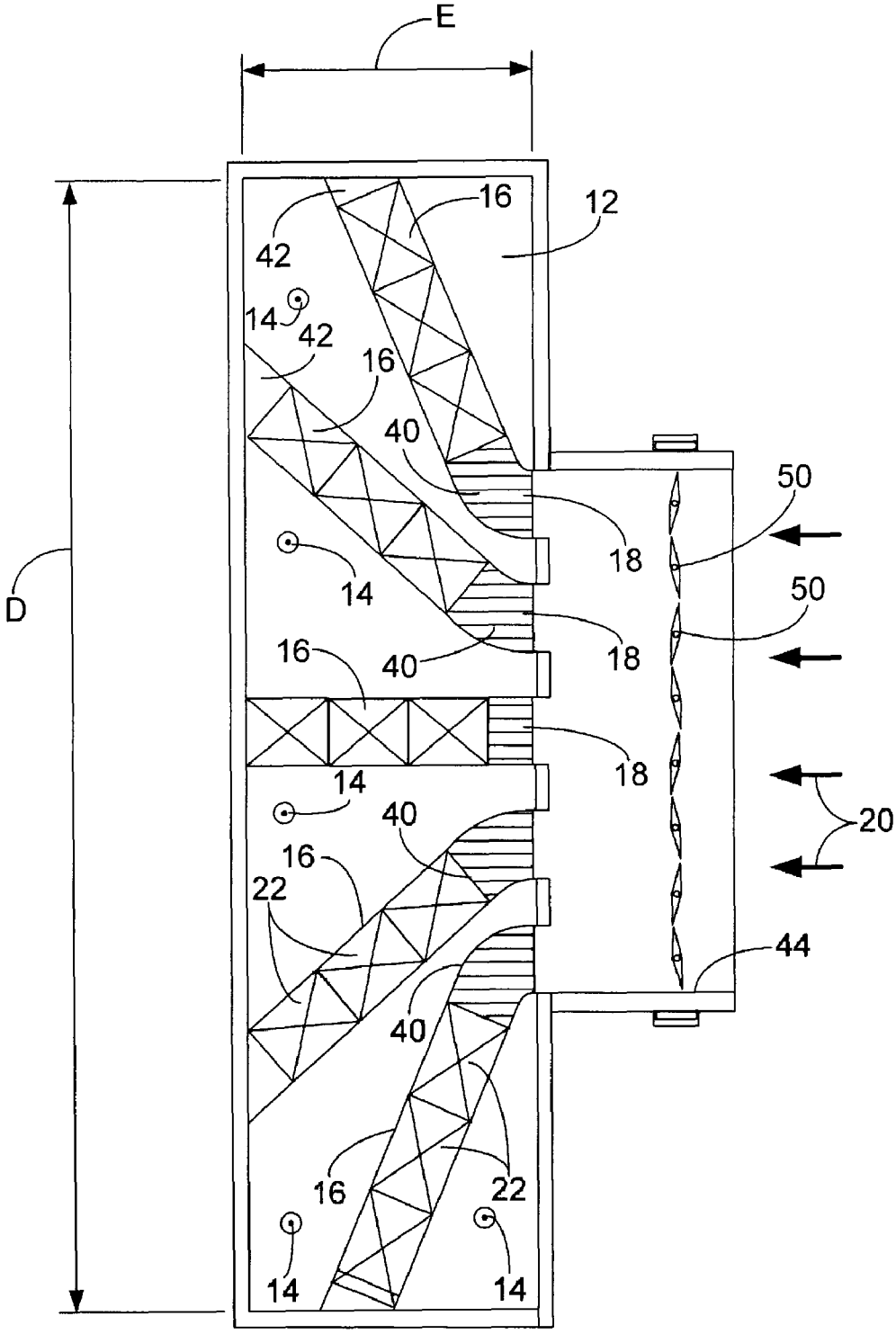
FIG. 1 is a top plan view if an apparatus for mixing two gas streams of different temperature or composition or both, with each other, where at least one of the streams contains particles, according to the present invention.

Referring now to the drawings, in which like reference numerals are used to refer to the same or similar elements, FIG. 1 shows an apparatus for mixing two gas streams 14 and 20 of different temperatures or different compositions or both, with each other, wherein at least one of the streams contains particles. The apparatus comprises a main duct 12 for carrying a first gas stream in a first direction 14, e.g. upwardly and thus out of the page in FIG. 1.

A plurality of duct assemblies 16 extend in the main duct 12, generally transversely to the first direction 14, each duct assembly 16 have a plurality of inlets 18 for each receiving part of the second gas stream 20 moving in from the right in FIG. 1, that is, in a second direction that is generally transverse to the first direction 14. The directions 14 and 20 may be about 90 degrees to each other but need not be exactly 90 degrees since any general amount of transverse orientation (e.g. from about 40 to 140 degrees) is effective.

Figure 2:
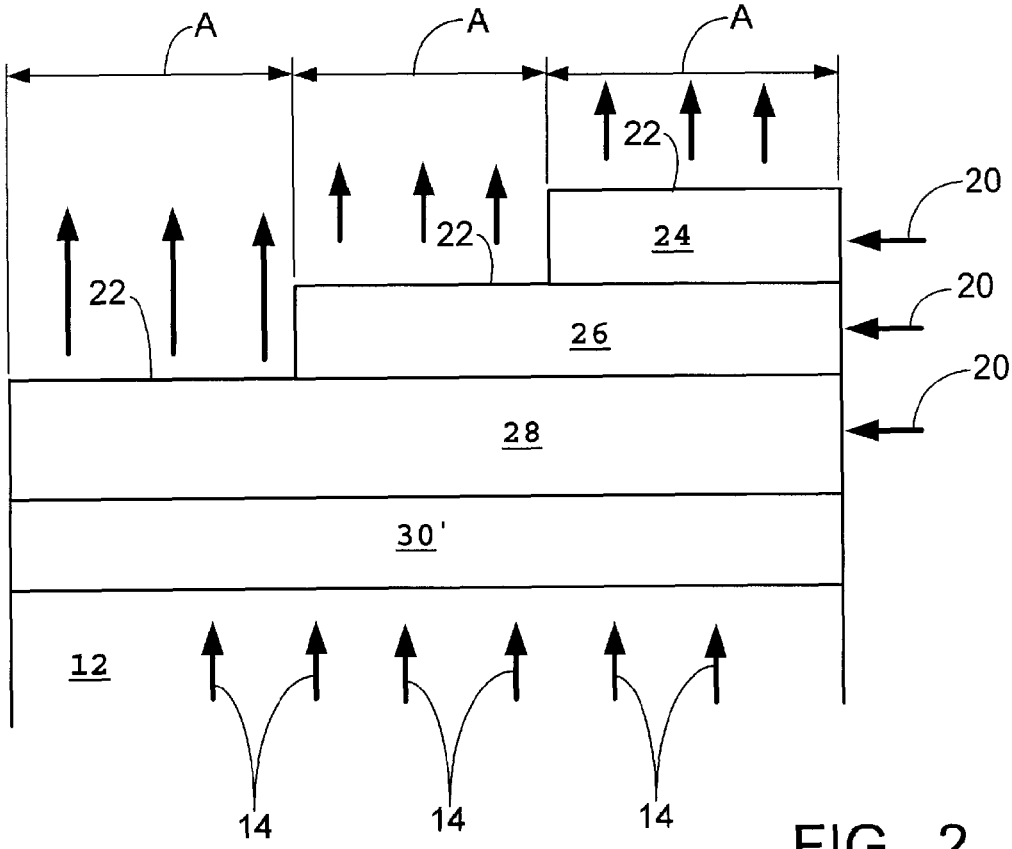
FIG. 2 is a side elevational view of one of plural secondary gas stream duct assemblies of the invention.
Figure 3:
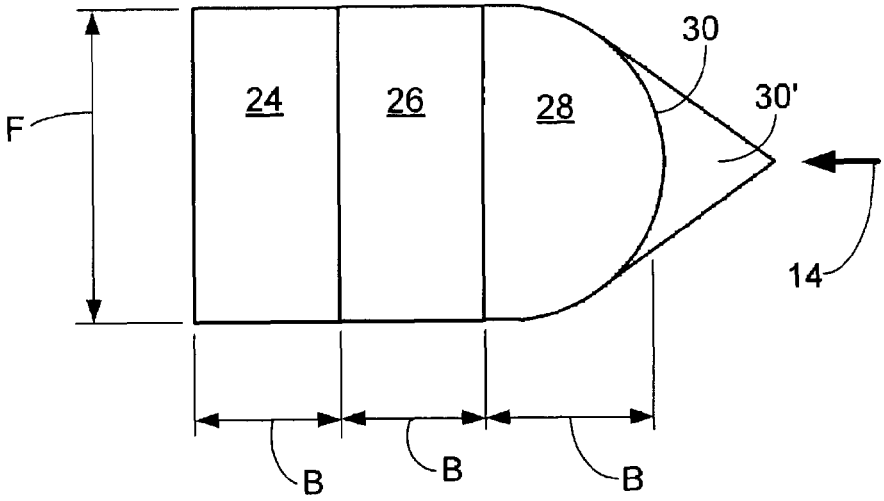
FIG. 3 is an end elevational view of the duct assembly of FIG. 2.
Figure 4:
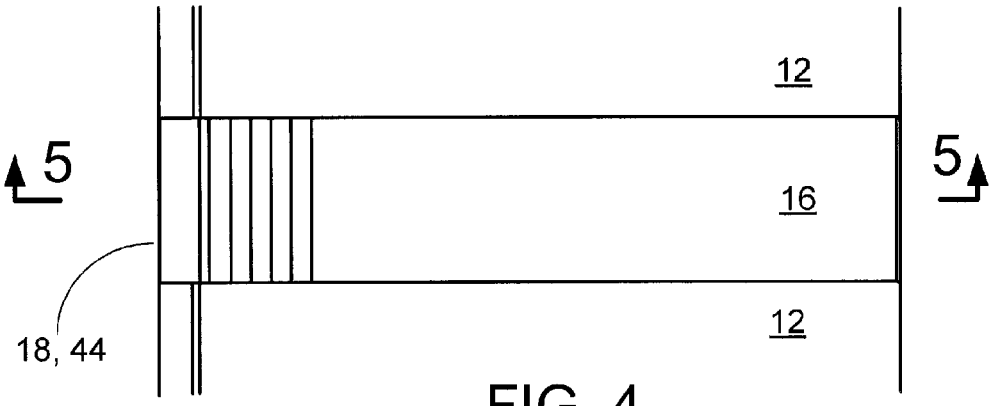
FIG. 4 is a top plan view of a second embodiment of one of a plural of secondary gas stream duct assemblies of the invention.

Referring now to FIGS. 2 and 3, each duct assembly 16 has a plurality of outlets 22 for discharging the parts of the second gas stream that entered the various inlets 18, in a direction that is generally parallel to the first direction 14, each duct assembly 16 comprising a plurality of secondary ducts 24, 26 and 28 that have mutually different lengths from its inlet 18 to its outlet 22, for each respective secondary duct 24, 26 or 28. The outlets 22 of the secondary ducts 24, 26 and 28 are spaced from each other across the main duct 12 for distributing the parts of the second gas stream into the first gas stream 14 in main duct 12. Plural assemblies 16 are provided to further distribute the multiple parts of the total second gas stream across the entire breadth and width of the main duct 12 as is evident from FIG. 1.

In the embodiment of FIGS. 2 and 3, a gas flow deflector 30 is connected to an upstream end of each duct assembly 16 facing the oncoming first main gas flow direction 14, for temporarily deflecting the first gas stream from the first direction 14 before it is combined with each part of the second gas stream 20 downstream of each outlet 22, for mixing the first and second gas streams with each other as the first gas stream passes the plurality of duct assemblies 16 in the main duct 12. The deflector 30 in this embodiment is a curved foil shape and is at a leading side of its respective duct assembly 16 facing the first direction 14 and opposite from the outlet 22 of each duct assembly 16. In an alternate embodiment that is also illustrated in FIG. 3, deflector 30' is a wedge shape with flat side walls (shown) or concave side walls (not shown) and is at the leading side of its respective duct assembly 16 facing the first direction 14 and again opposite from the outlet 22 of each duct assembly 16.

For a sense of scale, the outlets 22 in FIG. 2 are each about 2.67 feet wide in dimension A for a total width of about 8 feet for main duct 12 and the same approximate maximum length for the central duct assembly 16 in the main duct 12 as shown in FIG. 1. The assemblies 16 having a bend 40 near their respective inlets 18 in FIG. 1 and extending outwardly of the central assembly 16 have a longer maximum length to help spread the outlets 22 of the various assemblies 16, facing upwardly, that thus, out of the page of FIG. 1, evenly across the area of the main duct 12 to better mix the streams with each other. Referring now to FIGS. 2 & 3, a typical height B of the shorter secondary ducts 24 and 26 is about 0.93 feet and a height C of about 1.14 feet of the longest duct 28. Dimension F that is perpendicular heights B and C, is typically about 2 feet. Although three secondary ducts as shown for each duct assembly, as few are two and as many and five may be used and the various dimensions can be selected depending on the gas streams to be services.

As is common to most embodiments of the invention and as is also illustrated in FIG. 1, the duct assemblies 16, other than the central one, each have the bend 40 from the second direction 20 at a location downstream of the inlets 18 of the secondary ducts 24, 26 and 28, to help spread the outlets and their respective secondary gas stream parts, about the main duct 12. An example of the length D of the main duct 12 is about 43 feet with a width E of about 11 feet to accommodate the 8 foot or greater length of each duct assembly 16. To avoid ash traps a filler such as plates 42 extend from the ends of assemblies 16 to the adjacent walls of main duct 12.

A common second gas stream duct 44 for supplying all of the second gas stream in direction 20 is also provided with louvers 50 that are shown in a closed position in FIG. 1 but which can be rotated on their respective actuator shaft to an open position that are parallel to each other for free passage of the second gas stream.

In FIGS. 4 to 8 another embodiment of the invention is illustrated wherein each deflector 30 is downstream of the outlet 22 of each secondary duct 24, 26 and 28, of each duct assembly 16, so that the parts of the second gas stream at the outlets 22, face the now oncoming first gas stream and direction 14, are mixed with the first gas stream in the main duct 12.

Figure 5:
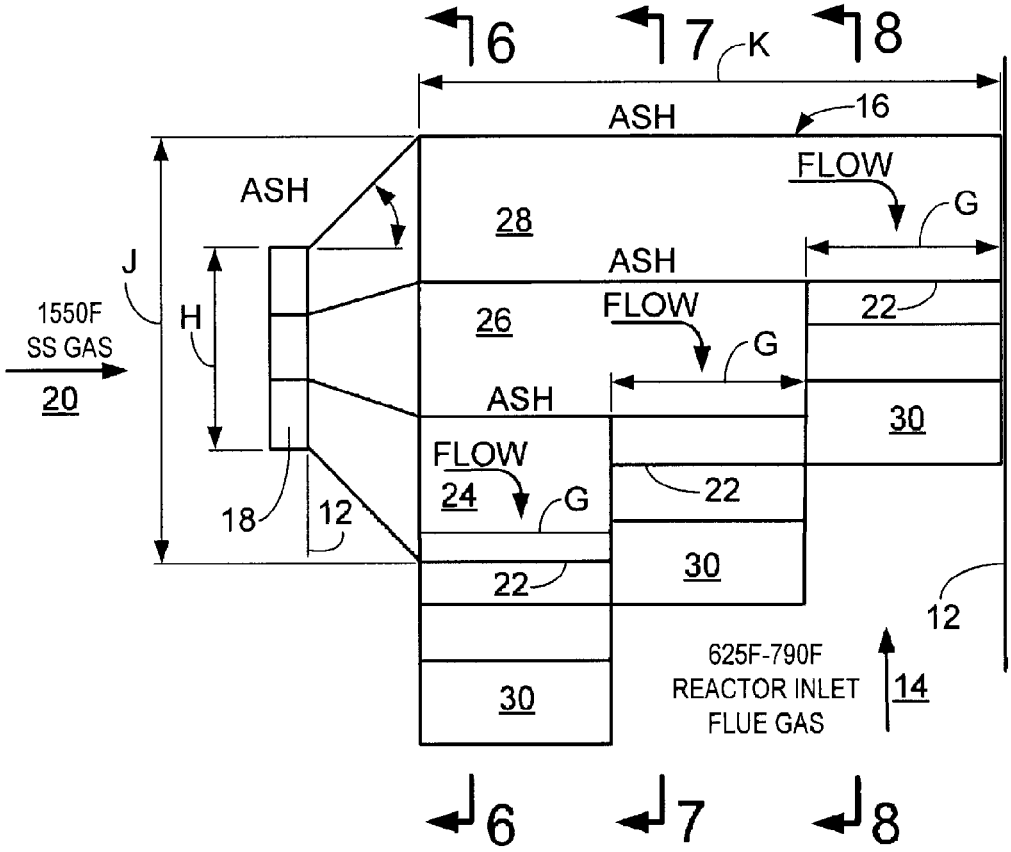
FIG. 5 is a side sectional view of the secondary gas stream duct assembly of FIG. 4, taken along line 5-5 of FIG. 4.
Figure 6:
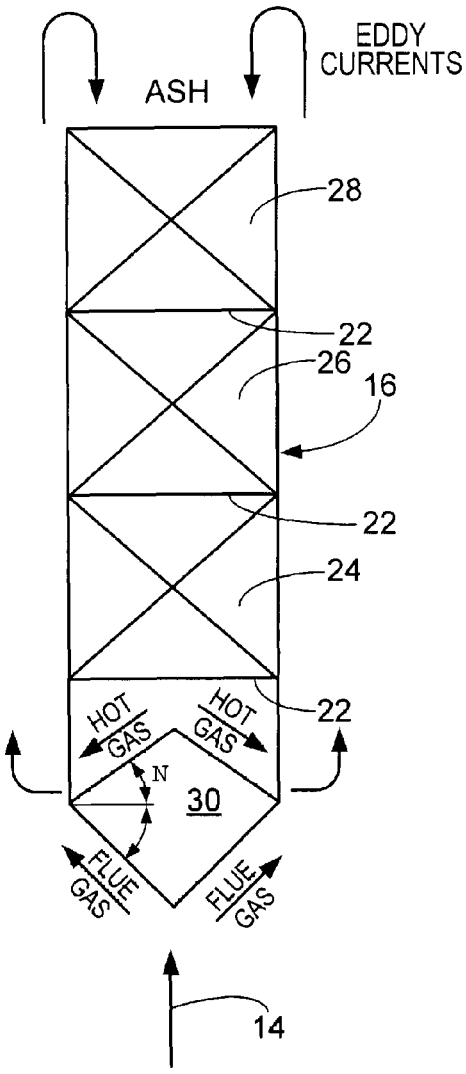
FIG. 6 is a side sectional view of the secondary gas stream duct assembly taken along line 6-6 of FIG. 5.

The deflectors 30 in FIG. 5-8 are each a diamond shape and they are each downstream of the outlet 22 of each duct assembly 16 so that the parts of the second gas stream at the outlets 22 face the first direction 14 and therefore the oncoming main gas stream, for being mixed with the first gas stream in the main duct 12. The side walls of the upstream and the downstream sides of the diamond shaped deflectors 30 many be flat as shown or may be convex or concave. As shown in FIG. 6, a typical upstream angle M may be about 45 degrees with a typical downstream angle N of about 35 degrees (FIG. 6). Typical inlet 18 width H in FIG. 5 is about 3 feet with a typical outlet 22 width G of abut 3 feet. A typical maximum duct assembly 16 length K is 9 feet in FIG. 5 and a typical assembly 16 width J is 6 feet.

Figure 7:
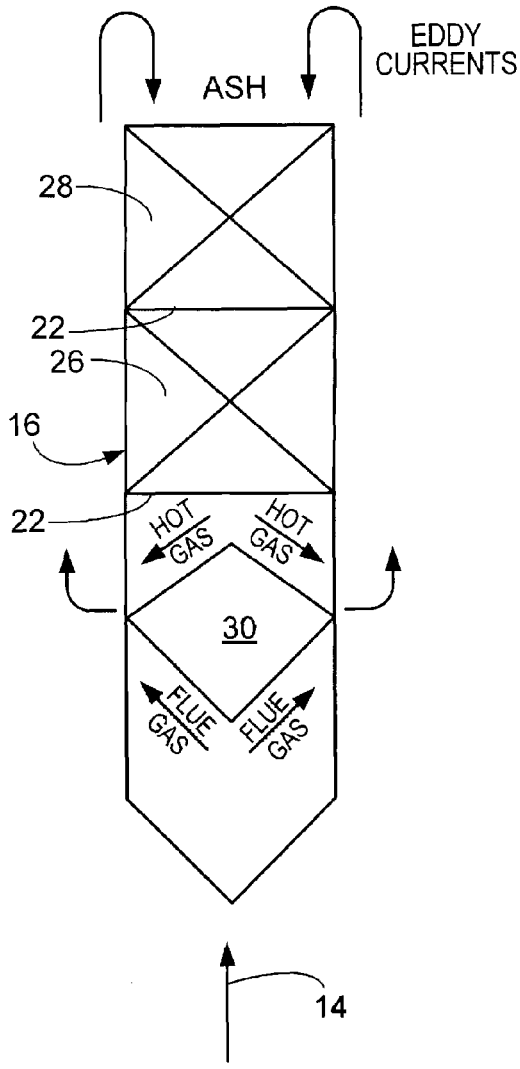
FIG. 7 is a side sectional view of the secondary gas stream duct assembly taken along line 7-7 of FIG. 5.
Figure 8:
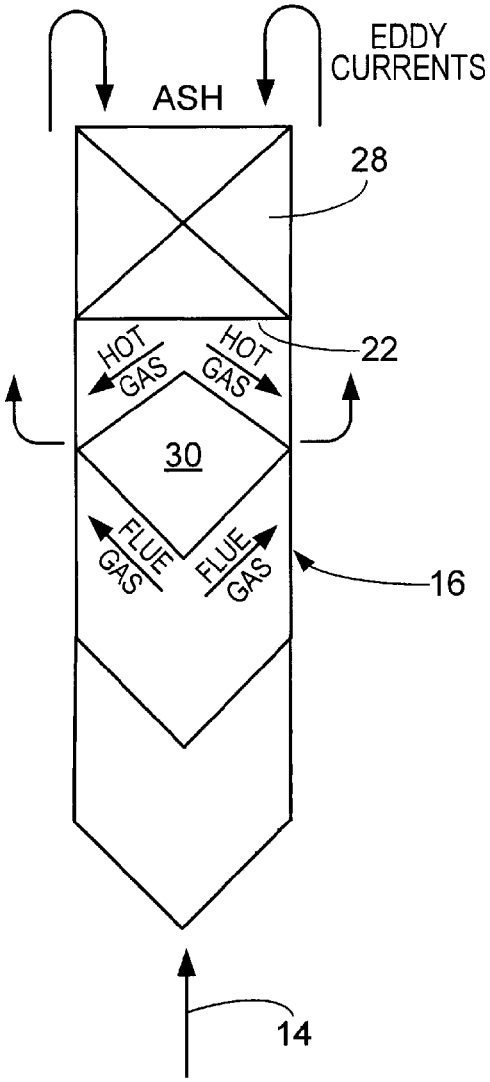
FIG. 8 is a side sectional view of the secondary gas stream duct assembly taken along line 8-8 of FIG. 5.

FIGS. 6 to 8 better show the upstream secondary gas streams from outlets 22 and the downstream primary gas streams 14 in main duct 12, as they are each partly diverted by the deflector surfaces of diamond defector 30 to thereafter be united and mixed at the sides of the deflectors 30 and then carried upwardly in FIGS. 6-8 in the first main or primary gas stream direction 14, where eddy current may cause particles such as ash to collect at the tops of the assemblies. These particles are quickly scattered by the continued main gas stream flow, upwardly in the illustrations of FIGS. 6-8.

Figure 9:
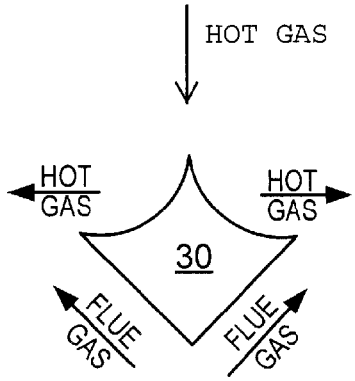
FIG. 9 is a sectional view of an alternate shape for a gas flow deflector that replaces the diamond shaped deflector of the embodiment of FIGS. 4-8.
Figure 10:
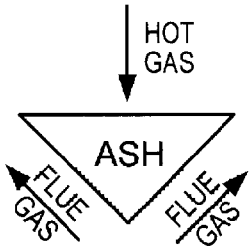
FIG. 10 is a sectional view of a further alternate shape for a gas flow deflector that replaces the diamond shaped deflector of FIGS. 4-8.

As illustrated in FIGS. 9 and 10, other deflector shapes are possible such as a wedge shape with flat side walls on the upstream side (FIGS. 9 and 10) with a flat transverse surface downstream of the outlet 22 (FIG. 10) or with concave surfaces downstream of the outlet 22 (FIG. 9), so that the parts of the second gas stream at the outlets 22 face the first direction 14 for being mixed with the first gas stream in the main duct.

Design requirements for secondary flues and SCR systems include the specification of flow distribution and thermal gradients downstream of the mixing devices. The objectives are to achieve flow uniformity and minimize thermal gradients. For example, in an SCR system mixing and flow uniformity at the ammonia injection grid should be sufficient such that catalyst performance and life is maintained. To accomplish these goals, devices such as those listed in the prior art have been utilized.

It is also desirable to minimize the unrecoverable pressure loss to the system. In addition, space restrictions limit the installation of an air foil for gas mixing and a separate AIG for ammonia distribution in an SCR system.

The invention described here uses some mixing features of the prior art to yield an integrated device that satisfies the system design requirements but with better pressure drop and other flow and mixture characteristics that would not be achieved by simply using the prior art apparatus. The invention is unique because it combines the mixing characteristics of air foils and/or diamond vanes to produce a device that promotes a uniform flow distribution with low pressure drop. The device also eliminates any limitations on the amount of recirculation flow through the invention by allowing for variations in the cross sectional flow area of the recirculation portion of the device. In addition, through the use of special discharge outlets, this invention can be used in vertical or horizontal oriented flues or ducts.

By integrating an air foil or diamond shape or other shaped deflector in front, flow uniformity downstream of the mixing device is achieved through the sizing of each outlet section that exits with the recirculated gas flow. The flow through each section is distributed in such a manner to give equal mixing with the main gas flow stream. The turbulence caused by the main gas flow moving around the air foil or diamond shaped front section of the mixing device provides the means to mix the main and recirculated gas streams downstream of the mixing device.

One feature of the invention is its flexibility to distribute the mixing gases within a non-uniform or complex flue or duct such as that of FIG. 1. One of the problems overcome by the invention is that in a vertical upflowing flue as shown in FIGS. 2 and 3, ash in the flue gas can settle out inside the mixing device if it is installed with the mixing device outlets placed to the downstream side of the flue. An additional problem of the prior art is the issue of insufficient gas mixing on the downstream side due to insufficient turbulence and gas stratification after the mixing device. To resolve this issue the mixing device must be installed with the discharge facing the upstream gas side of the mixing device and special deflector attachments will be required to minimize the displacement of ash into the mixing device flues.

In FIGS. 4 to 8, the discharge from the invention incorporates an outlet flow deflector which is used to discharge the flow within the device into the bulk gas stream. By incorporating this feature for discharging the gas into the bulk gas steam, the orientation of this mixing device is not influenced by the ash in the flue gas and particle build-up inside the mixing device will be minimized. This feature is a special concept of the invention which allows the device to be used in either horizontally and vertically oriented flues. This feature is also new for vertically upward gas flues where particles could easily be collected in the mixing device. When the system is not in use, normal leakage flow around the bypass dampers would clear any ash build up within the mixing device. Optional types of discharge outlet designs are shown in FIGS. 9 and 10.

The mixing of the two flue gas streams minimizes the thermal gradients in a similar manner to the air foils that were described in the prior art. Through good mixing of the flue gas streams, small variations in temperature over the cross section of the flue are achieved.

Alternatives within the scope of the invention use air foils to distribute the flue gas within the flue and to include plates or baffles to promote flow mixing in the flue/duct. The disadvantage of such an arrangement is added pressure loss, potential degradation mixing, and a larger flue to accommodate the system components, however.

While specific embodiments of the invention have been shown and described in detail to illustrate the application of the principles of the invention, it will be understood that the invention may be embodied otherwise without departing from such principles.

We claim:

1. An apparatus for mixing two gas streams of different temperatures or different compositions or both, with each other, wherein at least one of the streams contains particles, the apparatus comprising:

a main duct (12) for carrying a first gas stream in a first direction (14);

a plurality of duct assemblies (16) extending in the main duct (12), generally transversely to the first direction (14), each duct assembly (16) have a plurality of inlets (18) for each receiving part of a second gas stream moving in a second direction (20) that is generally transverse to the first direction (14), each duct assembly (16) also have a plurality of outlets (22) for discharging a part of the second gas stream in a direction that is generally parallel to the first direction (14), each duct assembly (16) comprising a plurality of secondary ducts (24, 26, 28) that have mutually different lengths from one inlet (18) to one outlet (22) for each respective secondary duct (24, 26, 28), the outlets (22) of the secondary ducts (24, 26, 28) being spaced from each other across the main duct (12) for distributing the parts of the second gas stream into the first gas stream; and a gas flow deflector (30) connected to each duct assembly (16) for temporarily deflecting the first gas stream from the first direction (14) before it is combined with each part of the second gas stream (20) downstream of each outlet (22) for mixing the first and second gas streams with each other as the first gas stream (14) passes the plurality of duct assemblies (16) in the main duct (12).

2. The apparatus of claim 1, wherein each deflector (30) is at a leading side of its respective duct assembly (16) facing the first direction (14) and opposite from the outlet (22) of each duct assembly (16).

3. The apparatus of claim 1, wherein each deflector (30) is downstream of the outlet (22) of each duct assembly (16) so that the parts of the second gas stream at the outlets (22) face the first direction (14) for being mixed with the first gas stream in the main duct.

4. The apparatus of claim 1, wherein at least one of the duct assemblies (16) has a bend (40) from the second direction (20) at a location downstream of the inlets (18) of the secondary ducts (24, 26, 28) of the at least one duct assembly (16).

5. The apparatus of claim 1, wherein the deflector is a curved foil shape and is at a leading side of its respective duct assembly (16) facing the first direction (14) and opposite from the outlet (22) of each duct assembly (16).

6. The apparatus of claim 1, wherein the deflector is a wedge shape and is at a leading side of its respective duct assembly (16) facing the first direction (14) and opposite from the outlet (22) of each duct assembly (16).

7. The apparatus of claim 1, wherein the deflector is a diamond shape and is downstream of the outlet (22) of each duct assembly (16) so that the parts of the second gas stream at the outlets (22) face the first direction (14) for being mixed with the first gas stream in the main duct.

8. The apparatus of claim 1, wherein the deflector is a wedge shape and is downstream of the outlet (22) of each duct assembly (16) so that the parts of the second gas stream at the outlets (22) face the first direction (14) for being mixed with the first gas stream in the main duct.

9. The apparatus of claim 1, wherein the deflector has a wedge shape with concave walls facing the outlet (22) of each duct assembly (16) and has a wedge shape with flat wall facing the first diction and the first gas stream that is oncoming to the deflector, so that the parts of the second gas stream at the outlets (22) face the first direction (14) for being mixed with the first gas stream in the main duct.

10. An apparatus for mixing gas streams of different temperatures and/or compositions wherein at least one of the streams contains particle, the apparatus comprising:

a main duct for a first gas stream and a plurality of duct assemblies extending in the main duct generally transversely to the first gas stream;

each assembly having a plurality of inlets and outlets for receiving and discharging separate parts of a second gas stream, moving initially generally transverse to the first stream, the assemblies each having a plurality of secondary ducts of mutually different lengths from inlet to outlet, the outlets being spaced from each other across the main duct for distributing the parts of the second gas stream into the first gas stream; and a gas flow deflector connected to each duct assembly for temporarily deflecting the first gas stream before it is combined with the parts of the second gas stream.

11. The apparatus of claim 10, wherein each deflector is at a leading side of its respective duct assembly facing the oncoming the first gas flow and being opposite from the outlet of each duct assembly.

12. The apparatus of claim 10, wherein each deflector is downstream of the outlet of each duct assembly so that the parts of the second gas stream at the outlets face the oncoming first gas stream for better mixed with the first gas stream in the main duct.

13. The apparatus of claim 10, wherein at least one of the duct assemblies has a bend from a direction of the second gad stream, at a location downstream of the inlets of the secondary ducts of the at least one duct assembly.

14. A method of mixing two gas streams of different temperatures or different compositions or both, with each other, wherein at least one of the streams contains particles, the method comprising:

carrying a first gas stream in a first direction (14) a main duct (12);

extending a plurality of duct assemblies (16) in the main duct (12), generally transversely to the first direction (14), each duct assembly (16) have a plurality of inlets (18) for each receiving part of a second gas stream moving in a second direction (20) that is generally transverse to the first direction (14), each duct assembly (16) also have a plurality of outlets (22) for discharging a part of the second gas stream in a direction that is generally parallel to the first direction (14), each duct assembly (16) comprising a plurality of secondary ducts (24, 26, 28) that have mutually different lengths from one inlet (18) to one outlet (22) for each respective secondary duct (24, 26, 28), the outlets (22) of the secondary ducts (24, 26, 28) being spaced from each other across the main duct (12) for distributing the parts of the second gas stream into the first gas stream;

supplying the second gas flow in parts to the outlets (18); and temporarily deflecting the first gas stream from the first direction (14) before it is combined with each part of the second gas stream (20) downstream of each outlet (22) using a gas flow deflector (30) connected to each duct assembly (16) for mixing the first and second gas streams with each other as the first gas stream (14) passes the plurality of duct assemblies (16) in the main duct (12).

15. The method of claim 14, wherein each deflector (30) is at a leading side of its respective duct assembly (16) facing the first direction (14) and opposite from the outlet (22) of each duct assembly (16).

16. The method of claim 14, wherein each deflector (30) is downstream of the outlet (22) of each duct assembly (16) so that the parts of the second gas stream at the outlets (22) face the first direction (14) for being mixed with the first gas stream in the main duct.

17. The method of claim 14, wherein at least one of the duct assemblies (16) has a bend (40) from the second direction (20) at a location downstream of the inlets (18) of the secondary ducts (24, 26, 28) of the at least one duct assembly (16).

18. The method claim 14, wherein the deflector is a curved foil shape and is at a leading side of its respective duct assembly (16) facing the first direction (14) and opposite from the outlet (22) of each duct assembly (16).

19. The method of claim 14, wherein the deflector is a wedge shape and is at a leading side of its respective duct assembly (16) facing the first direction (14) and opposite from the outlet (22) of each duct assembly (16).

20. The method of claim 14, wherein the deflector is a diamond shape and is downstream of the outlet (22) of each duct assembly (16) so that the parts of the second gas stream at the outlets (22) face the first direction (14) for being mixed with the first gas stream in the main duct.

21. The method of claim 14, wherein the deflector is a wedge shape and is downstream of the outlet (22) of each duct assembly (16) so that the parts of the second gas stream at the outlets (22) face the first direction (14) for being mixed with the first gas stream in the main duct.

22. The method of claim 14, wherein the deflector has a wedge shape with concave walls facing the outlet (22) of each duct assembly (16) and has a wedge shape with flat wall facing the first diction and the first gas stream that is oncoming to the deflector, so that the parts of the second gas stream at the outlets (22) face the first direction (14) for being mixed with the first gas stream in the main duct.

* * * * *